US006231421B1

(12) United States Patent
Ruocchio

(10) Patent No.: US 6,231,421 B1
(45) Date of Patent: May 15, 2001

(54) LOW POWER ILLUMINATION SYSTEM FOR SCALE MODELS

(76) Inventor: Albert C. Ruocchio, 429 Chadwick Dr., Raleigh, NC (US) 27609-4561

( * ) Notice: Subject to any disclaimer, the term of this patent is extended or adjusted under 35 U.S.C. 154(b) by 0 days.

(21) Appl. No.: 08/951,723

(22) Filed: Oct. 16, 1997

(51) Int. Cl.[7] ..... A63H 17/28
(52) U.S. Cl. ..... 446/438; 362/479
(58) Field of Search ..... 446/431, 438, 446/439; 362/479, 218, 310

(56) References Cited

U.S. PATENT DOCUMENTS 2,779,133 * 1/1957 Zion ..... 446/438
3,526,054 * 9/1970 Raman ..... 446/115 X
5,221,140 * 6/1993 Oshino ..... 362/255
5,222,799 * 6/1993 Sears et al. ..... 362/146
5,352,147 * 10/1994 Nagel et al. ..... 446/409
5,433,024 * 7/1995 Lerner ..... 362/546
5,521,799 * 5/1996 VerKamp ..... 362/83.2
5,544,025 * 8/1996 Bohlool et al. ..... 362/95
5,611,720 * 3/1997 Vandermaas ..... 446/47

* cited by examiner

*Primary Examiner*—Kien T. Nguyen

(57) ABSTRACT

A low-power lighting system for illuminating the interior of scale models such as model railroad cars is disclosed. The lighting system includes a plurality of miniature bulbs in the 2.5 to 3.0 Volt range operating at 100 milliamps that are soldered directly to a printed circuit board in lieu of socket mounting to provide a low-profile configuration to the assembled lighting system which can be installed within the interior roof structure of a scale model so as to be hidden from exterior view. The printed circuit board which carries the miniature bulbs is configured to fit various standard classes of model railroad cars and scale model buildings to permit interior details thereof to be displayed. The lighting system dissipates the heat intensity of the miniature bulbs over the entire surface area of the printed circuit board to eliminate hot spots and warpage of plastic model structures.

8 Claims, 4 Drawing Sheets

LOW POWER ILLUMINATION SYSTEM FOR SCALE MODELS

BACKGROUND OF INVENTION

FIELD OF INVENTION

This invention relates to low power illumination systems and, more particularly, to a low power lighting apparatus for illuminating the interior of model railroad cars and other scale models.

Lighting systems for illuminating model railroad cars and other toy models are well known to those skilled in the art. For example, model railroad enthusiasts are familiar with the frosted window material including painted silhouettes utilized in the windows of model railroad passenger cars which are internally illuminated.

Such lighting systems for model railroad cars typically utilize high temperature bulbs having a screw or bayonet connector at the base which produce a hot spot within the railroad car. For example, such an internal lighting system is disclosed in U.S. Pat. No. 2,779,133.

While such high temperature bulbs are acceptable in the classic metal-bodied Lionel and American Flyer railroad cars of the past, they are unsuitable for use in the modern plastic models because they tend to warp or melt the model they are illuminating.

In recent years, there has been a trend to constructing model railroad cars with clear windows and detailed, realistic interiors. In order to accomplish this it is desirable to mount the lighting system on the internal roof of the model so as not to be visible from the exterior. Thus, there is a need for a miniature, low power lighting system that will produce even illumination of the interior of such models without warpage or melting.

DESCRIPTION OF RELATED PRIOR ART

U.S. Pat. No. 2,779,133 to Moses Zion discloses a toy observation car used in model railroads including incandescent light bulbs installed on the interior thereof for illumination.

U.S. Pat. No. 5,221,140 to Hiroshi Oshino discloses a sub-miniature lamp in which a lamp body having a filament and an envelope is covered with a soft silicon rubber cap of a predetermined color having an opening at one end to a predetermined length of wire leads extending from the lamp body.

U.S. Pat. No. 5,352,147 to Dietmar Nagel discloses a toy vehicle including a vehicle body having a transparent portion wherein a pluralilty of illuminating devices are disposed such that the emitted light is transmitted through the transparent portion for viewing from the exterior of the body.

U.S. Pat. No. 5,611,720 to John Vandermaas discloses a flying disc toy of the FRISBEE® type having an internal lighting system used in conjunction with a glow-in-the-dark body.

U.S. Pat. No. 5,222,799 to Lawrence A. Sears et al. discloses a lighting strip for supplying low level lighting in stair cases.

U.S. Pat. No. 5,433,024 to Richard D. Lerner discloses an edge-lighted display including a transparent acrylic plate having openings to receive illumination sources. Incandescent sub-miniature lamps are mounted to a circuit board and are closely coupled to the openings in the plate.

U.S. Pat. No. 5,521,799 to Kevin M. VerKamp discloses an illuminated display assembly having a plurality of lighting devices for illuminating an indicia plate carried in the available license plate mounting area of a vehicle.

U.S. Pat. No. 5,544,025 to Perry P. Bohlool et al. discloses an outlet cover plate incorporating a night light including a series string of low-voltage lamps.

Finally, U.S. Pat. No. 3,526,054 to Kizhanatham R. Raman is considered of general interest in that it discloses a prefabricated wall construction with electrical power supply and appliance installations.

SUMMARY OF THE INVENTION

After much research and study of the above mentioned problems, the low power lighting system of the present invention has been developed to provide even illumination of the interior compartment of model railroad cars and other toy models.

The present invention utilizes a plurality of miniature bulbs that include a glass envelope and bare wire leads rather than a conventional socket base which are soldered directly to a printed circuit board configured for a particular application. The miniature bulbs are arranged in a series or parallel arrangement depending upon the operating voltage and light requirements.

More particularly, the bulbs are disposed in series strings of 6 to 8 bulbs each which are wired in parallel and interleaved so that if one of these strings has a failure, the remaining will carry a lower level of evenly distributed light over the length of the circuit board.

The printed circuit board provides a low cost lighting assembly and also acts as a heat absorbing shield to protect the roof structure of the model railroad car whereon it is to be installed, and it is not at all visible to a person looking into the model from the exterior.

The resulting lighting is extremely even over any interior configuration for a model railroad car or other model application.

In view of the above, it is an object of the present invention to provide a low power, low heat intensity lighting system to provide even illumination of an interior compartment of a model railroad car or other toy model.

Another object of the present invention is to provide a low heat intensity lighting system suitable for use with model railroad cars of plastic construction to prevent warpage and melting thereof.

Another object of the present invention is to provide a low power lighting system including a plurality of miniature bulbs having wire leads which are soldered directly to a printed circuit board without the use of standard socket bases to reduce the cost of manufacturing.

Another object of the present invention is to provide a low power lighting system wherein a plurality of miniature bulbs are arranged in series strings wherein each of the series strings are wired in parallel and interleaved such that if one of the strings has a failure, the remaining series strings will carry a lower level of even illumination over the length of the printed circuit board.

Other objects and advantages of the present invention will become apparent and obvious from a study of the following description and the accompanying drawings which are merely illustrative of such invention.

DETAILED DESCRIPTION OF INVENTION

Figure 1:
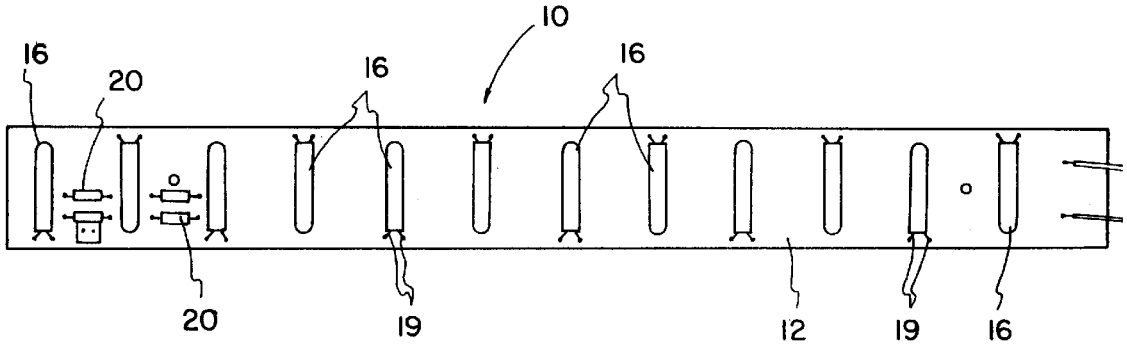
FIG. 1 is a top plan view of one embodiment of the low power lighting system of the present invention including a plurality of miniature bulbs arranged on a printed circuit board and attached to an external power supply.

With further reference to the drawings there is shown therein a low power lighting system for use in illuminating scale model railroad cars and other toy models, indicated generally at 10 and illustrated in FIG. 1.

Figure 4:
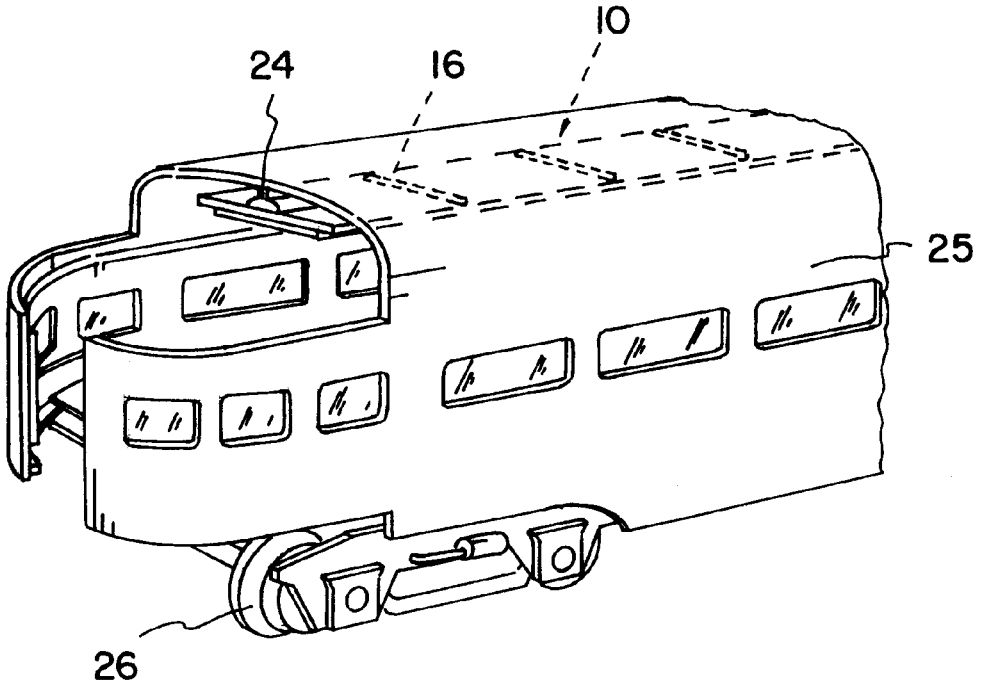
FIG. 4 is a partially cutaway perspective view of a model railroad car showing the present invention installed on the interior thereof. Note that installation in a scale model would be similar to this arrangement.

In the embodiment shown the apparatus for illuminating the interior of a model railroad car 25 as in FIG. 4 includes an elongated, rectangular printed circuit board 12 being fabricated to predetermined dimensions.

In the present invention the printed circuit board 12 is fabricated from an electrically nonconductive, heat-absorbing material which functions to protect the model structure from exposure to heat generated by the lighting system as hereinafter described.

Figure 2:
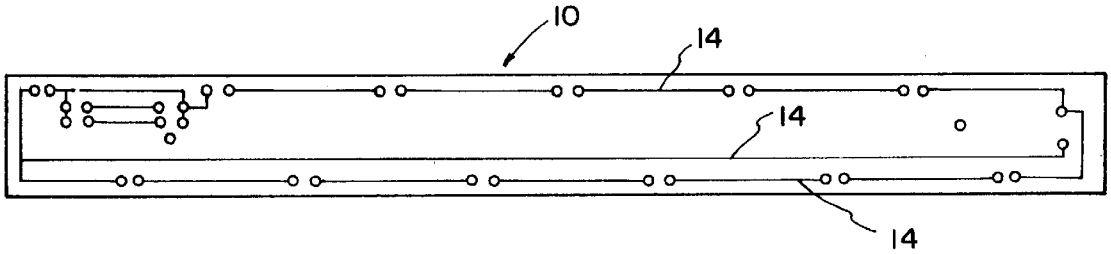
FIG. 2 is a bottom plan view of the low power lighting system shown in FIG. 1 showing the reverse side thereof including the electrical circuits and connections.

The printed circuit board 12 includes a plurality of electrical pathways or circuits 14 formed on one surface thereof as shown in FIG. 2 to provide for the transmission of electricity between various components mounted thereon and powered by an external power supply 11 as shown in FIG. 1.

A plurality of miniature bulbs 16 are installed at predetermined intervals on the printed circuit board 12. In the preferred embodiment these miniature bulbs 16 operate in the 2.5–3.0 Volt range at 100 milliamps. However, it will be appreciated by those skilled in the art that other similar bulbs 16 rated at various voltages and currents could be utilized in a given application.

Figure 3:
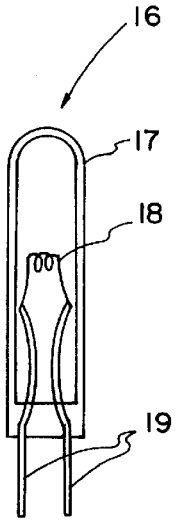
FIG. 3 is a schematic representation of a miniature light bulb of the type utilized in the present invention.

It is significant that in the present invention, the miniature bulbs 16 include a transparent glass tube 17 as shown in FIG. 3 forming an envelope wherein a filament 18 is disposed. Filament 18 is electrically connected to a pair of lead wires 19 extending from a bottom end of the glass tube 17. This configuration allows a stable positioning of the bulbs 16 for soldering the lead wires 19 to a predetermined position on the printed circuit board 12 depicted in FIG. 2.

It is critical to the present invention that the miniature bulbs 16 are baseless rather than being socket mounted as is the case with a conventional incandescent bulb (not shown). In this configuration the wire leads 19 may be bent at right angles to an axis of the glass tube 17 to provide a low-profile cross section to the assembled lighting system 10.

In such a configuration the lighting system assembly 10 as depicted in FIG. 1 can be installed on the interior roof structure 24 of a model railroad car 25 without being visible from the exterior thereof as shown in FIG. 4.

Figure 5:
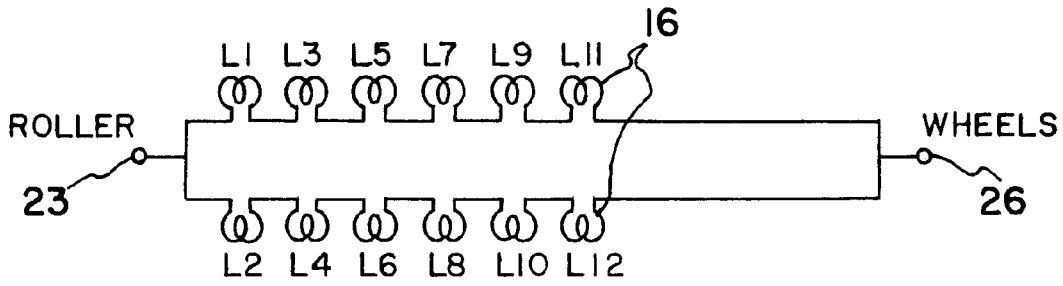
FIG. 5 is an electrical schematic depicting an alternative embodiment of the low power lighting system.

Referring now to FIG. 5 there is shown therein a schematic diagram of a circuit for use in a specific category of model railroad cars i,e. Passenger Cars wherein the present invention is used to illuminate the interior thereof. It will be appreciated that the circuit depicted in FIG. 5 can be utilized in Passenger Cars of both long and short classes varying in length from approximately 12 to 19 inches by fabricating a corresponding printed circuit board 12 to fit the specific class of Passenger Car.

The basic embodiment of the low-power light system 10 as shown in FIG. 5 comprises two series circuits of miniature bulbs 16, the first being designated L2, L4, L6, L8, L10 and L12; the second series circuit being designated L1, L3, L5, L7, L9, L11. The wheels 26 of the railroad car 25 provide the ground for the circuit and the roller pickup as at 23 of the railroad car 25 supplies the voltage from a model railroad track (not shown) in a conventional manner.

Since such model railroad tracks are well known to those skilled in the art further detailed discussion of the same is not deemed necessary.

In prior art applications to illuminate a standard passenger car, two incandescent lamps rated at 14 to 16 Volts operating 120 milliamps are typically mounted on the floor of a car 25 in a standard size socket. Such lamps, of course, interfere with the interior details of the Passenger Car, provide uneven lighting, and produce a so-called hot spot due to the heat intensity of the lamp.

These problems are solved by the present invention which provides even illumination of the interior with no hot spot because the total power dissipated in the lighting system is 3.5 watts maximum and spread out over an area of 15 to 20 square inches which is the surface area of the printed circuit board 12.

Figure 6:
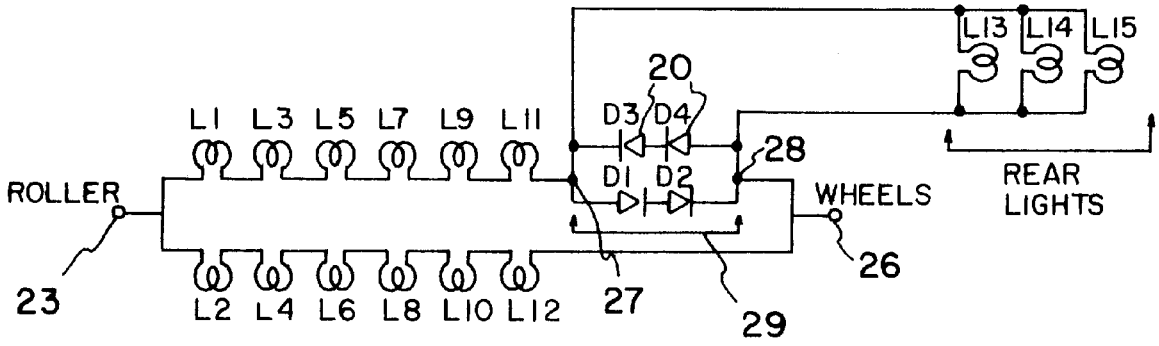
FIG. 6 is an electrical schematic representing another alternative embodiment of the low power lighting system.

Referring now to FIG. 6 there is shown therein an electrical schematic for another category of model railroad cars i.e. Observation Cars, which in addition to the basic embodiment depicted in FIG. 5 utilize three additional miniature bulbs 16 designated L13, L14, and L15 for on-board rear lights. In the Observation Car a pair of these miniature bulbs 16 serve as warning indicators to a following train and the third bulb serves to illuminate the so-called Drum Head which may display the logo of the railroad or the specific name of a train such as $20^{th}$ Century, Broadway Century, Broadway Limited, Daylight, etc.

The voltage to these additional bulbs iv L13, L14 and L15 is regulated by the four diodes 20 designated as D1, D2, D3, and D4 arranged in series parallel as shown in FIG. 6. This prevents the voltage to the bulbs L13, L14 and L15 from exceeding 1.5 Volts.

In the embodiment of FIG. 6, the voltage applied ranges from 13 Volts AC or DC to 18 Volts AC or DC. Accordingly, the miniature bulbs 16 selected for this application are 2.5 Volts operating at 100 milliamps. Because the total current required for the rear bulbs i.e. L13, L14, and L15 is 90 milliamps, the diodes 20 must regulate only about 10 milliamps of current. The addition of 1.5 Volts in the rear bulb circuit has very little effect on the overall illumination of the interior of the car.

The low-power lighting system of the present invention can be adapted for virtually any size model railroad car or other toy model or any applied voltage. This calculation is based upon the equation:

$$V_{applied}=N(V_{Bulb})$$

In the case at hand, the maximum applied voltage is 18 Volts AC or DC and assuming the length of the railroad cars (N) is determined to be six, the voltage of the miniature bulbs 12 would be 2.5 Volts. Such a miniature bulb with a voltage of 2.5 Volts is a relatively common bulb that is commercially available without a socket for use in the present invention.

As a practical matter, if it is desired to adapt the printed circuit board 12 configured for Observation Cars as shown in FIG. 6, to that of a Passenger Car, a jumper wire 29 may be installed between the terminal points 27 and 28 by-passing the diodes 20 and the rear lights L13, L14, and L15.

Figure 7:
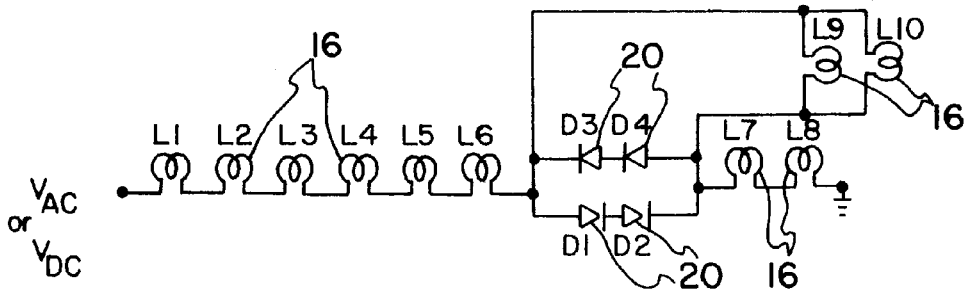
FIG. 7 is an electrical schematic depicting yet another alternative embodiment of the low power lighting system.

Referring now to FIG. 7 there is shown therein an alternative embodiment of the low power lighting system 10 of the present invention configured to illuminate a Caboose Car (not shown) which carries a pair of marker bulbs 16 designated L9 and L10 with one on each side of the rear end of the caboose.

In this application the marker bulbs 16 are 1.5 Volt bulbs operating at 30 milliamps (ma). The voltage to the marker bulbs L9 and L10 is regulated by four diodes 20 arranged in series parallel and designated as D1, D2, D3, and D4.

The diodes 20 prevent the voltage passing to the bulbs L9 and L10 from exceeding 1.5 Volts.

This circuit also includes eight miniature bulbs 16 arranged in series and designated as L1, L2, L3, L4, L5, L6, L7, and L8 in addition to the series parallel combination of the diodes D1, D2, D3, and D4.

In this particular application the voltage applied is from 13 Volts AC or DC to 18 Volts AC or DC requiring the selection of bulbs 12 rated at 2.5 Volts at 100 milliamps (ma).

Because the total current needed for the rear marker bulbs L9 and L10 is 60 milliamps, the four diodes 20 must regulate only about 40 milliamps of current. The addition of 1.5 Volts each in the circuit has very little effect on the overall illumination of the Caboose Car. In fact, the use of eight bulbs 16 for this application rated at 2.5 Volts reduces the light intensity and is more realistic in that such Caboose Cars were originally illuminated by lanterns.

This embodiment can be adapted for any size model train and any applied voltage. The calculation is based on the equation:

$$V_{applied}=(N(V_{Bulb})\times 1.33)$$

In the case at hand the maximum applied voltage is 18 Volts AC or DC and the length of the Caboose Car (N) is determined to be six. Thus, the voltage of the bulbs is required to be 2.5 Volts, which is readily available commercially.

Figure 8:
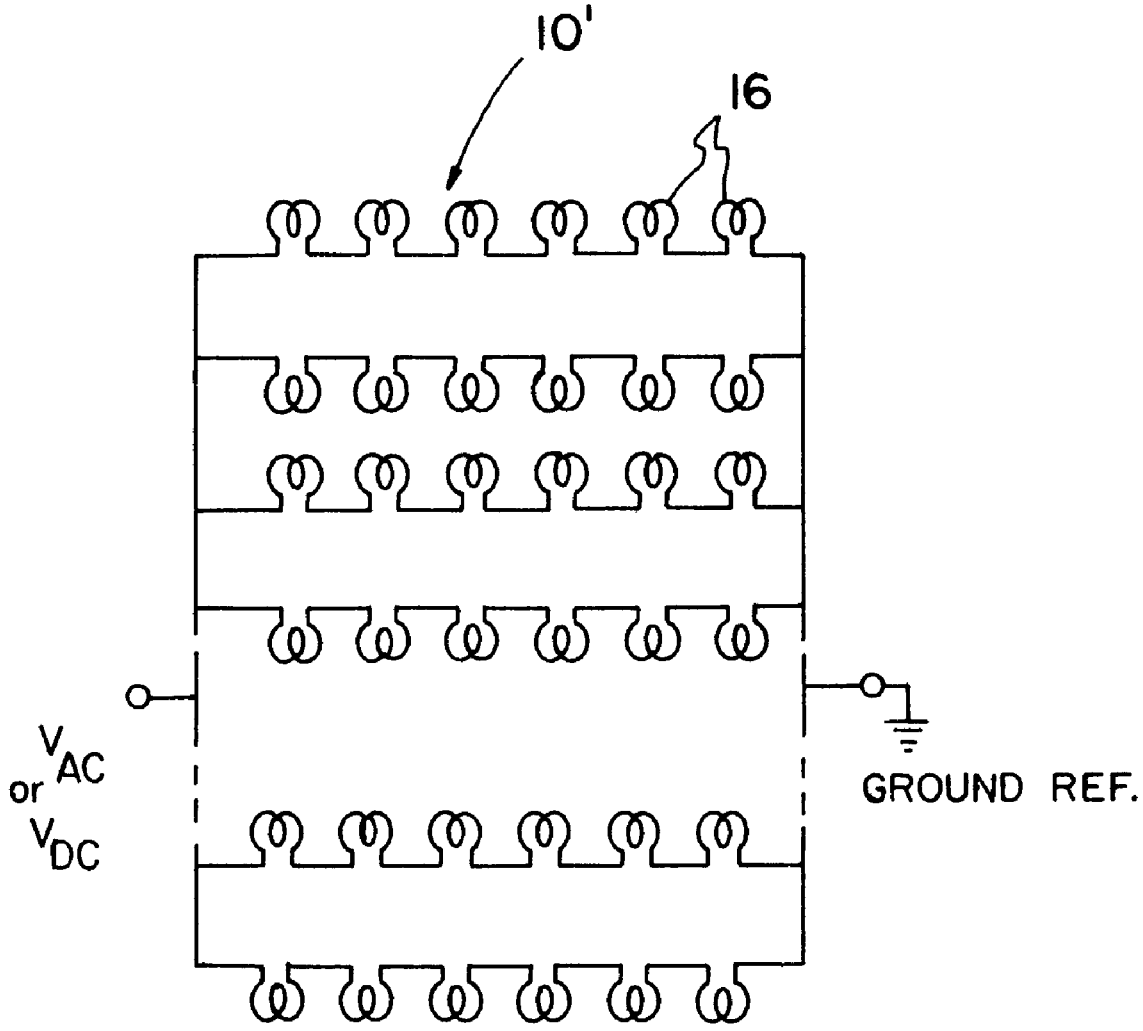
FIG. 8 shows another alternative embodiment of the low-power system.

Referring now to FIG. 8 there is shown therein yet another alternative embodiment of the low-power system 10' of the present invention adapted for use in scale model buildings (not shown) which are commonly utilized in model railroad layouts.

In this embodiment multiple series strings including six bulbs 16 each are arranged in parallel as shown. In this application, there is a fixed voltage available ranging from 15 to 18 Volts AC or DC requiring bulbs rated at 2.5 Volts operating at 100 milliamps.

As described hereinabove the miniature bulbs 16 are mounted on a generally square printed circuit board (not shown) which is configured to fit the interior roof structure of a scale model building. In this manner even illumination of the interior of the building can be achieved without being visible from the exterior thereof. In similar fashion, the low-power lighting system 10' disclosed herein can be adapted for any size model building and any applied voltage.

The calculation is based on the equation:

$$V_{applied}=N(V_{Bulb})$$

In the case at hand, the maximum applied voltage is 18 Volts AC or DC and given that the bulbs in this application are determined to be N=six, the voltage of the miniature bulbs 16 is required to be 2.5 Volts, which is readily available commercially without a socket.

From the above it can be seen that the low-power lighting system of the present invention provides a practical apparatus for illuminating the interior of model railroad cars and other scale models to display the interior details thereof.

The lighting system of the present invention provides even illumination with the dissipation of heat over the entire surface area of a printed circuit board thereby eliminating hot spots and warpage of the illuminated model.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A low power illumination system for scale models, comprising:

a scale model member having walls covered by a roof to define an interior and having windows for observing said interior;

a planar circuit board member including first connilector means, said circuit board disposed in said interior and having an upper surface connected to said roof and a lower facing exposed to said interior;

second connector means electrically connected to said first connector means and extending outwardly of the model member for connection to a power supply;

a plurality of miniature light bulbs mounted on said lower surface of said circuit board member and electrically connected to said first connector means, said light bulbs positioned with respect to said windows whereby illumination of said light bulbs will illuminate said interior without said light bulbs being directly visible through said windows.

2. The illumination system as recited in claim 1 wherein said miniature bulbs are disposed at predetermined intervals to provide even illumination of said interior.

3. The illumination system as recited in claim 1 wherein said light bulbs have longitudinal axes parallel to said lower surface.

4. The illumination system as recited in claim 1 wherein said light bulbs are arranged in sets and each set is disposed at separated discrete portions of said interior.

5. The illumination system as recited in claim 4 wherein said scale model is a railroad car.

6. The illumination system as recited in claim 5 wherein said railroad car has an elongated longitudinally extending roof and said circuit board extends substantially thereunder.

7. The illumination system as recited in claim 6 wherein an auxiliary light bulb is electrically connected to said first connector means and mounted on a wall for direct visibility on the exterior of said scale model.

8. The illumination system as recited in 5 wherein said railroad car has discrete locations in said interior and said circuit board member includes a first circuit board located at a first discrete location and a second circuit board located at a second discrete location.

* * * * *